US006991468B1

(12) United States Patent
Lynch et al.

(10) Patent No.: US 6,991,468 B1
(45) Date of Patent: Jan. 31, 2006

(54) FOLDED FOIL AND METAL FIBER BRAID ELECTRICAL CURRENT COLLECTOR BRUSH

(75) Inventors: William A. Lynch, Philadelphia, PA (US); Neal A. Sondergaard, Severna Park, MD (US); Wayne Marks, Jr, Suldersville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/985,075

(22) Filed: Nov. 5, 2004

(51) Int. Cl.
*H01R 39/00* (2006.01)

(52) U.S. Cl. ..... 439/13

(58) Field of Classification Search ..... 439/13, 439/25, 26, 862; 310/71, 70 R, 69, 239, 310/242; 277/355
See application file for complete search history.

(56) References Cited

U.S. PATENT DOCUMENTS 4,166,227 A * 8/1979 Guglielmo ..... 310/242
5,039,898 A * 8/1991 Shiina ..... 310/239
5,777,410 A * 7/1998 Asakura et al. ..... 310/71
5,915,988 A * 6/1999 Bitsch et al. ..... 439/398
6,464,230 B1 * 10/2002 Tong et al. ..... 277/355
6,628,036 B1 9/2003 Lynch et al. ..... 310/242
6,760,965 B2 * 7/2004 Asao et al. ..... 29/596

* cited by examiner

*Primary Examiner*—Chandrika Prasad

(74) *Attorney, Agent, or Firm*—Jacob Shuster

(57) ABSTRACT

A brush assembly is formed from a single metallic foil positioned within a base portion. The foil is folded or rolled up into a plurality of closely spaced foil layers soldered to the base portion of the brush assembly. Attachment of the folded foil to the brush base portion involves use of barrier tape and/or adhesive on the folded side of the foil layers and soldering of one layer edge to the base portion which is received within a holder to position the folded foil in brushing contact along the other layer edges with a running surface under a spring bias pressure. The brush may be constructed by metal fiber braids placed on or between metal skins to form a hybrid structure. The brush assembly may be applicable to slip ring current collectors or other electric contact applications, including cleansing brush applications involving other types of brushes.

7 Claims, 2 Drawing Sheets

FOLDED FOIL AND METAL FIBER BRAID ELECTRICAL CURRENT COLLECTOR BRUSH

STATEMENT OF GOVERNMENT INTEREST

The invention described herein may be manufactured and used by or for the Government of the United States of America for governmental purposes without the payment of any royalties thereon or therefore.

The present invention relates to the transfer of electrical current across a moving surface in an electric current collecting device.

BACKGROUND OF THE INVENTION

Currently many slip-ring brushes are made from solid carbon. Metal fiber brushes are generally known for providing a much larger number of electrical contact points on the rotor running surface thereby providing a much lower contact voltage drop. However such metal fiber brushes, supported by holders to which they are attached by soldering, are readily deformed by high external forces, which may arise in electrical motor types of environments because of transport current and magnetic field interaction induced forces, which results in excessive brush spreading distortion sometimes called splay. Brushes could be made stronger by using larger fibers, but this would result in fewer contact points and poor following of any imperfections in the rotor surface. It is therefore an important object of the present invention to provide a foil type electrical current collector brush in the aforementioned type of running surface environments to avoid the latter referred to disadvantages associated therewith.

SUMMARY OF THE INVENTION

Pursuant to the present invention, a single foil sheet is folded into closely spaced layers bonded together and soldered within a base portion of a brush assembly positioned within a holder in spaced relation to a running surface of an electrical current collector type of device, so that one of the folded foil sheet edges on the spaced layers thereof extending from the holder is held under pressure in sliding contact with the running surface. The brush may be fabricated by use of a single piece of folded metal foil, folded in such a way as to keep the free ends near the center, thereby providing the desired mechanical strength and avoiding the requirement for assembling a plurality of stacked foils heretofore associated with prior foil concepts. Other embodiments of the invention involve use of metal fiber braids between each set of adjacent foil folds, thereby providing an increased number of contact points and improved electrical performance similar to that of a fiber brush. The foil and braids are soldered together at the base thereby providing a low resistance path to the brush holder. The folded foil brush may also be well suited for rotor slip ring cleansing when used with other brush types.

DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
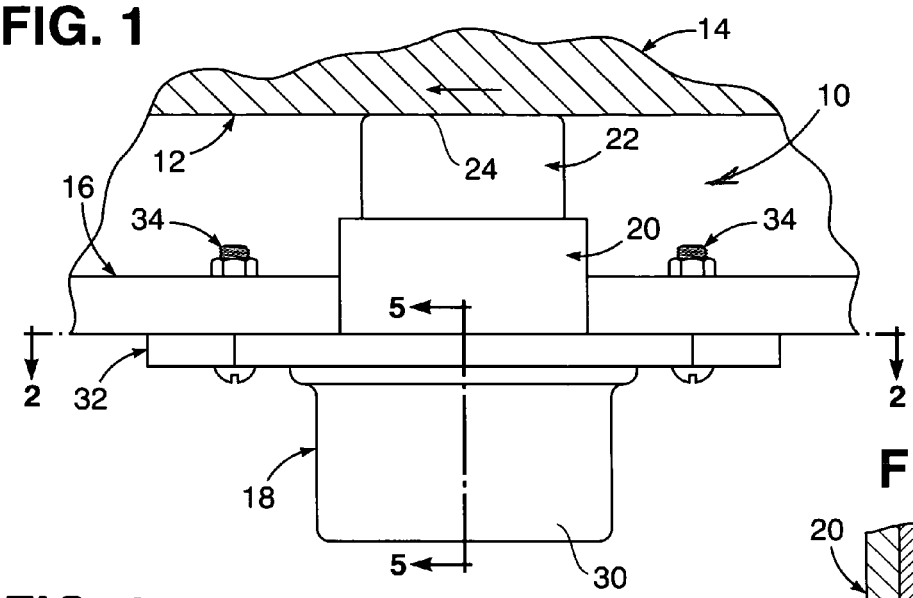
FIG. 1 is a partial side elevation view illustrating installation of a brush assembly in sliding contact with a running surface within an electric current collecting device.

Referring now to the drawing in detail, FIG. 1 illustrates a brush assembly 10 in sliding contact with a running slip ring surface 12 of an electric current collecting type of device 14, as generally known in the art, with which a fixed support 16 is associated in spaced relation to the slip-ring surface 12. Pursuant to the present invention, the brush assembly 10 is positioned on the support 16 by a holder 18 to establish sliding contact thereof with the running surface 12 of the device 14.

Figure 2:
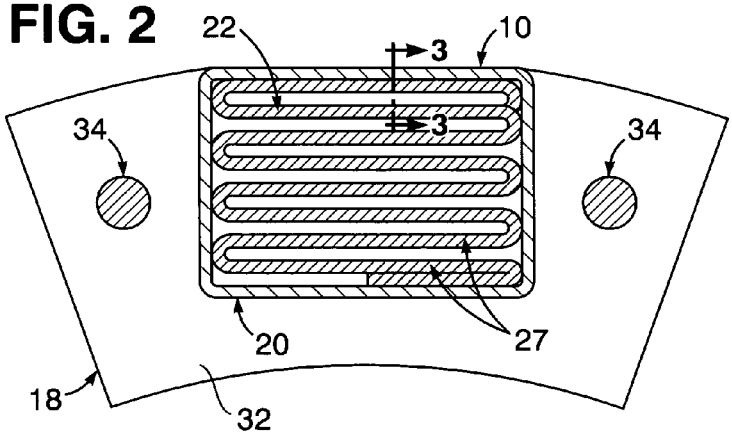
FIG. 2 is a section view taken substantially through a plane indicated by section line 2—2 in FIG. 1.
Figure 3:
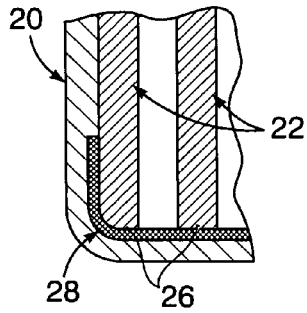
FIG. 3 is a partial section view taken substantially through a plane indicated by section line 3—3 in FIG. 2.
Figure 5:
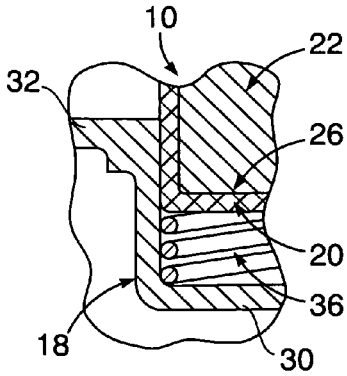
FIG. 5 is a partial section view taken substantially through a plane indicated by section line 5—5 in FIG. 1.
Figure 4:
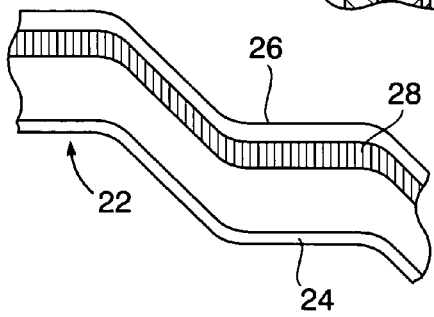
FIG. 4 is a partial perspective view of a partially unfolded electrically conductive foil sheet disassembled from the brush assembly illustrated in FIGS. 1, 2 and 3.

As shown in FIGS. 1, 2 and 3, the brush assembly 10 has a base portion 20 that is cross-sectionally rectangular shaped. A folded metal foil 22 is positioned within the base portion 20 and projects therefrom into said sliding contact with the surface 12. As shown in FIG. 4, the foil 22 is a single sheet having opposite parallel spaced edge 24 and 26 that are folded into parallel spaced relation to each other when the foil 22 is fully folded for installation into the brush assembly 10 as shown in FIG. 2. When completely folded and installed within an optional container formed within the portion 20, the brush foil 22 sometimes referred to as a sock, forms a plurality of closely spaced rectangular layers 27 as shown in FIGS. 2 and 3. The folded edge 24 of the foil 22 is then in contact with the surface 12 as shown in FIG. 1, while the other folded foil edge 26 is soldered throughout to the brush base portion 20 as shown in FIG. 5. As to the sides of the folded foil layers 27 extending between the opposite foil edges 24 and 26, a small portion thereof has a barrier tape 28 or adhesive coating thereon as shown in FIG. 4 for attachment of the foil 22 to the base portion 20 as shown in FIG. 3. Such attachment is effected before soldering of the foil edges 26 to the base 20 so as to prevent wicking after installation of the brush assembly 10 within the electric current collecting device 14.

As shown in FIGS. 1 and 5, the brush holder 18 is formed by a housing 30 within which the brush base portion 20 is received and soldered thereto. The holder 18 has an arcuate flange 32 for axial slip ring application as shown in FIGS. 1, 2 and 5, extending from the housing 30 for releasable attachment by bolts 34 to the support 16. A coil spring 36 within the holder housing 30, as shown in FIG. 5, exerts brush contact pressure on the brush assembly 10 through the base portion 20. Such contact pressure is applied to the running surface 12 along parallel spaced sections of the folded contact edge 24 on the foil layers 27. As shown in FIG. 2 the folded foil layers 27 of the brush assembly 10 may be made of an electrically conductive metal, such as brass shim stock for example or another suitable metal such as copper, silver or palladium.

Figure 3A:
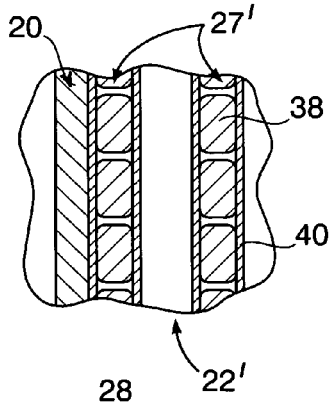
FIG. 3A is a partial section view corresponding to that of FIG. 3, and the embodiment illustrated in FIG. 2A.
Figure 2C:
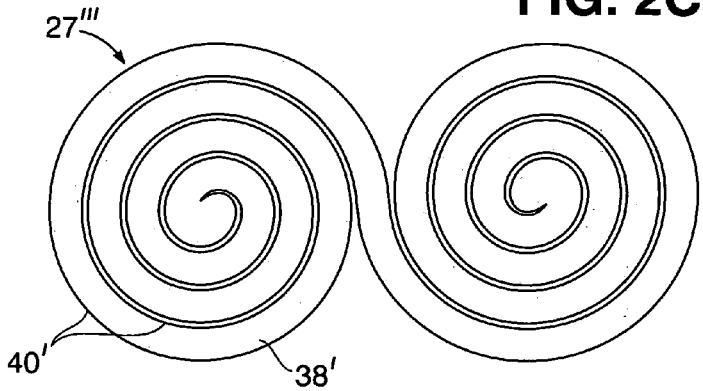
FIGS. 2A, 2B and 2C are section views of different hybrid foil layer embodiments of the brush assembly as shown in FIG. 2.
Figure 2A:
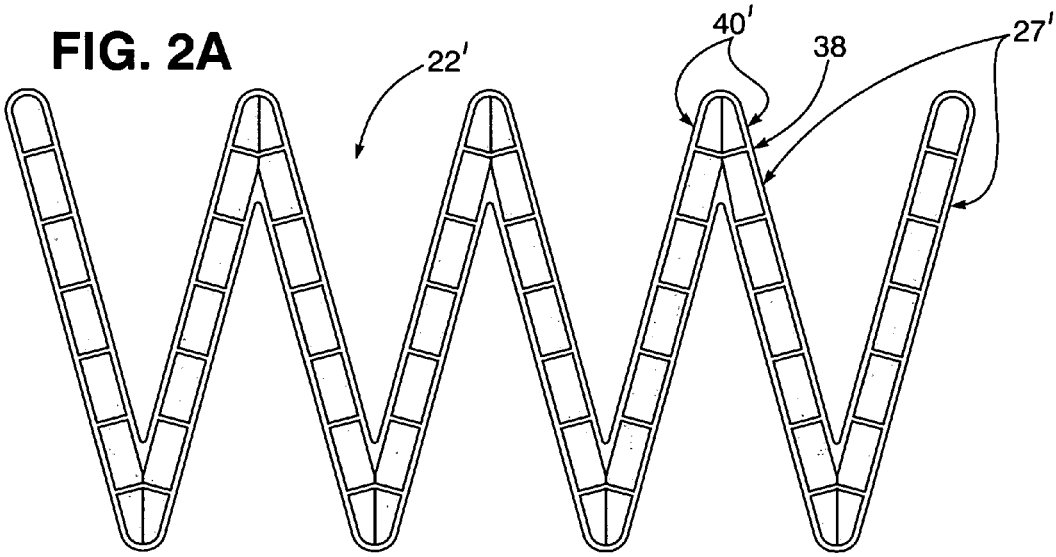
Figure 2B:
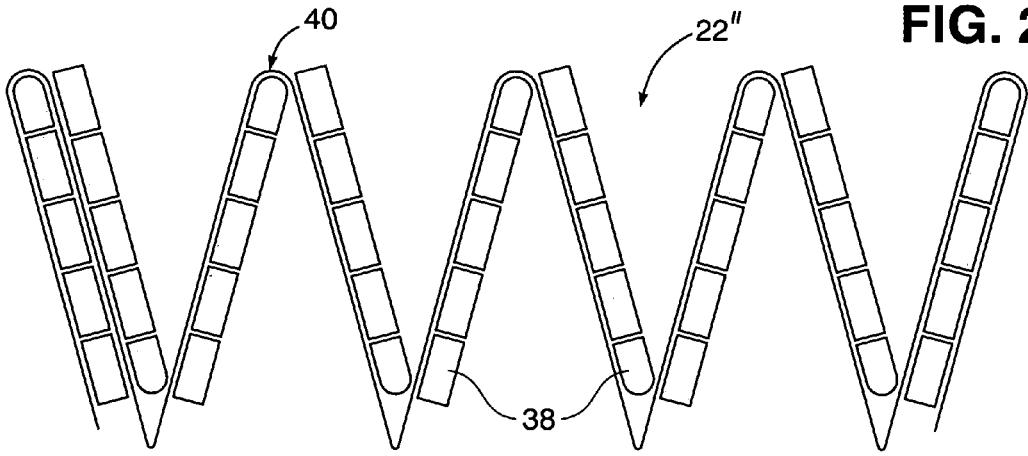

According to another embodiment as shown in FIGS. 2A and 3A, a foil 22' is folded into foil layers 27' of a hybrid structure type, having braids 38 positioned between two outer skins 40 of each of the layers 27' to form a container shell or sock. According to yet another embodiment a hybrid foil 22" may be folded to form a closed structure, as shown in FIG. 2B, without an outer container shell or sock by attachment of the braids 38 to a single folded skin 40. A still further embodiment is cross-sectionally illustrated in FIG. 2C, wherein a hybrid foil 22'" is shown in a double jellyroll structural arrangement, having outer skins 40' with an inner braid 38' retained therebetween.

Figure 6:
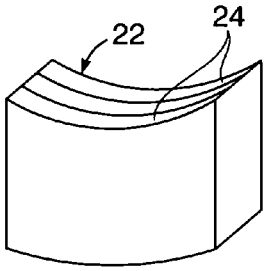
FIG. 6 illustrates a foil component of the brush assembly shown in FIG. 1.

In regard to the outer shape of the flange 32 as hereinbefore described with respect to FIGS. 1, 2 and 5, it would be cylindrical for the brush assembly 10 in a radial installation relative to the slip ring surface 12. The shape of the foil contact edges 24 may be curved as shown in FIG. 6, to a degree dependent on the curvature of the slip ring surface 12.

Obviously, other modifications and variations of the present invention may be possible in light of the foregoing teachings. It is therefore to be understood that within the scope of the appended claims the invention may be practiced otherwise than as specifically described.

What is claimed is:

1. A brush assembly for current transfer or cleansing of an electrically conductive running surface within an electric current collecting environment, comprising: a single foil folded into closely spaced foil layers with parallel spaced edges; a base within which the foil layers are soldered thereto along one of said edges thereof; and holder means within which the base is received for positioning of the folded foil with the other of the folded layer edges in sliding contact with the running surface under pressure.

2. The brush assembly as defined in claim 1, including barrier tape means on the foil layers for confined attachment thereof to the base in spaced relation to said edges of the foil layers.

3. The brush assembly as defined in claim 2, wherein said holder means comprises: a housing within which the base is received; and spring means within the housing for exerting said pressure on the foil maintaining said contact of the running surface with said other of the edges on the foil layers.

4. The brush assembly as defined in claim 1, wherein said holder means comprises: a housing within which the base is received; and spring means within the housing for exerting said pressure on the foil maintaining said contact of the running surface with said other of the edges on the foil layers.

5. The brush assembly as defined in claim 1, wherein said foil is made of a thin solid metal sheet folded into the foil layers.

6. The brush assembly as defined in claim 1, wherein said foil is a hybrid layer of brush braids between outer metallic skins.

7. The brush assembly as defined in claim 1, wherein said foil is a hybrid layer of brush braids on a metallic skin.

* * * * *